US005174133A

United States Patent [19]

Kawase et al.

[11] Patent Number: 5,174,133

[45] Date of Patent: Dec. 29, 1992

[54] APPARATUS AND METHOD FOR ADJUSTING THE STITCH ON A CIRCULAR KNITTING MACHINE

[75] Inventors: Yoji Kawase, Kitamachi; Takao Shibata, Osaka, both of Japan

[73] Assignee: Precision Fukuhara Works, Ltd., Hyogo, Japan

[21] Appl. No.: 719,928

[22] Filed: Jun. 24, 1991

[51] Int. Cl.[5] ..... D04B 15/00; D04B 35/00

[52] U.S. Cl. ..... 66/57; 66/146

[58] Field of Search ..... 66/57, 146

[56] References Cited

U.S. PATENT DOCUMENTS

| | | | |
|---|---|---|---|
| 3,757,536 | 9/1973 | Claiborne | 66/57 X |
| 4,523,440 | 6/1985 | Voisin et al. | 66/146 |
| 4,829,790 | 5/1989 | Memminger et al. | 66/146 X |

FOREIGN PATENT DOCUMENTS

| | | | |
|---|---|---|---|
| 0310845 | 4/1989 | European Pat. Off. | 66/57 |
| 2425084 | 5/1974 | Fed. Rep. of Germany | 66/57 |
| 2643185 | 4/1977 | Fed. Rep. of Germany | 66/57 |
| 2198753 | 6/1988 | United Kingdom | 66/57 |

*Primary Examiner*—Peter Nerbun
*Assistant Examiner*—John J. Calvert
*Attorney, Agent, or Firm*—Bell, Seltzer, Park & Gibson

[57] ABSTRACT

An automatic stitch cam adjustment mechanism for a circular knitting machine is disclosed. The knitting machine includes a plurality of knitting needles supported in a rotating needle cylinder for vertical movement parallel to the axis of rotation of the needle cylinder. A plurality of cam support brackets surround the needle cylinder, and a plurality of stitch cam support members are slidably mounted on the cam support brackets for vertical movement thereon. Stitch cams are mounted on the stitch cam support members for engaging the needles and lowering the needles to a loop formation point. A drive motor is connected to each of the stitch cam support members for moving the stitch cam support members up and down. Sensors are included for (1) measuring the position of the movable support members along the vertical path of movement, (2) detecting the rotational speed of the needle cylinder, and (3) measuring a feeding characteristic of the yarn such as yarn feed tension or quantity. A controller is operatively connected to the drive motors and sensors for comparing each of the sensed values with a predetermined knitting machine operating standard and actuating the drive motors for adjusting the stitch cams as needed.

17 Claims, 3 Drawing Sheets

APPARATUS AND METHOD FOR ADJUSTING THE STITCH ON A CIRCULAR KNITTING MACHINE

FIELD OF THE INVENTION

The invention relates to a mechanism for automatically adjusting the vertical positions of the stitch cams on circular knitting machines so that the proper length or size of stitch loops are formed at each knitting station.

BACKGROUND OF THE INVENTION

On a circular knitting machine, the stitch cams at each knitting station are manually adjusted for changing the length or size of the formed stitch loops. Typically, the stitch cams are adjusted by manually rotating a screw or a cam operatively connected to moveable support members on which the stitch cams are secured. In another proposed stitch cam adjustment mechanism, an automatic rotary actuator mechanism is operatively connected to the support members. The rotary actuator mechanism is adjusted for moving the support member for automatically adjusting the support member and the stitch cam secured thereto.

These mechanisms have several drawbacks. Manually adjusting a screw or cam requires a high degree of skill and the final critical adjustment relies primarily upon the skill and experience of the operator for insuring proper stitch cam height adjustment. A rotary actuator occupies the position on the knitting machine where multiple yarn feeders are normally positioned. Thus, the number of yarn feeders possible on this type of knitting machine is reduced when a rotary actuator is incorporated therein.

In one proposed knitting machine, an automatic stitch adjusting mechanism is incorporated at each yarn feeding position for adjusting the height of the stitch cam support members to a predetermined level. The mechanism includes a clutch and lever mechanism engaging a stitch cam control member for locking the control member and for controlling movement of the stitch cam support member. In this mechanism and in other manually adjustable stitch cam raising mechanisms, the stitch cams remain in a fixed position after the adjustment. During high speed knitting operation, the forces generated against the machine components as well as the generated heat and resultant thermal expansion of the machine components result in both the stitch cam height and yarn tension varying from a predetermined knitting machine operating standard. As a result, the fabric quality is lowered.

SUMMARY OF THE INVENTION

It is therefore an object of the present invention to provide for automatic adjustment of the stitch cam level in a circular knitting machine, based on changing yarn feed characteristics such as a change in tension or quantity of yarn fed to the knitting machine.

The circular knitting machine in accordance with the present invention provides for automatic adjustment of the stitch cam height based on measured feeding characteristics of the yarn, such as the yarn tension or quantity of yarn fed to the machine. In one embodiment the yarn feed tension is measured, and in another embodiment, the quantity of yarn fed to the knitting machine measured.

The circular knitting machine includes a plurality of knitting needles supported in a rotating needle cylinder for vertical movement parallel to the axis of rotation of the needle cylinder. A plurality of cam support brackets surround the needle cylinder. A plurality of stitch cam support members are slidably mounted on the cam support brackets for vertical movement thereon. Stitch cams are mounted on the vertically moveable stitch cam support members for engaging the needles and lowering the needles to a loop formation point. Drive means is connected to each of the stitch cam support members for moving the stitch cam support members up and down.

In a preferred embodiment, the position of the movable support member along the vertical path of movement is sensed, and then the rotational speed of the needle cylinder is detected. A feeding characteristic of the yarn such as the yarn feed tension or the quantity of yarn fed to the machine is measured. These values are input to a controller and the sensed values compared with a predetermined knitting machine operating machine standard. If the compared results vary from the operating standard, the stitch cam support members are vertically moved for adjusting the size of the stitch loops being formed by the knitting machine.

In a preferred embodiment, the controller includes means generating a drive signal for actuating the drive means and moving the stitch cam support members when a sensed value varies from the predetermined knitting machine operating standard. In one embodiment, a positive yarn feed system is used for feeding yarn to the knitting needles. When a positive yarn feed system is used, the measured feeding characteristic is the yarn tension. When a nonpositive feed system is used, the quantity of yarn fed to the machine is utilized. In a preferred embodiment, springs are supported in the cam support brackets and engage the stitch cam support members for biasing upward the stitch cam support members. Sensing means is operatively connected to each spring for sensing the amount of force exerted against each of the stitch cam support members. Based on the sensed force, the position of the movable support members along the vertical path of movement is calculated. A method for automatically adjusting the stitch cams of a knitting machine also is disclosed in accordance with the present invention.

DESCRIPTION OF THE DRAWINGS

Other objects and advantages of the present invention will become apparent as the description proceeds when taken in connection with the accompanying drawings, in which.

DETAILED DESCRIPTION OF THE PREFERRED EMBODIMENT

Figure 2:
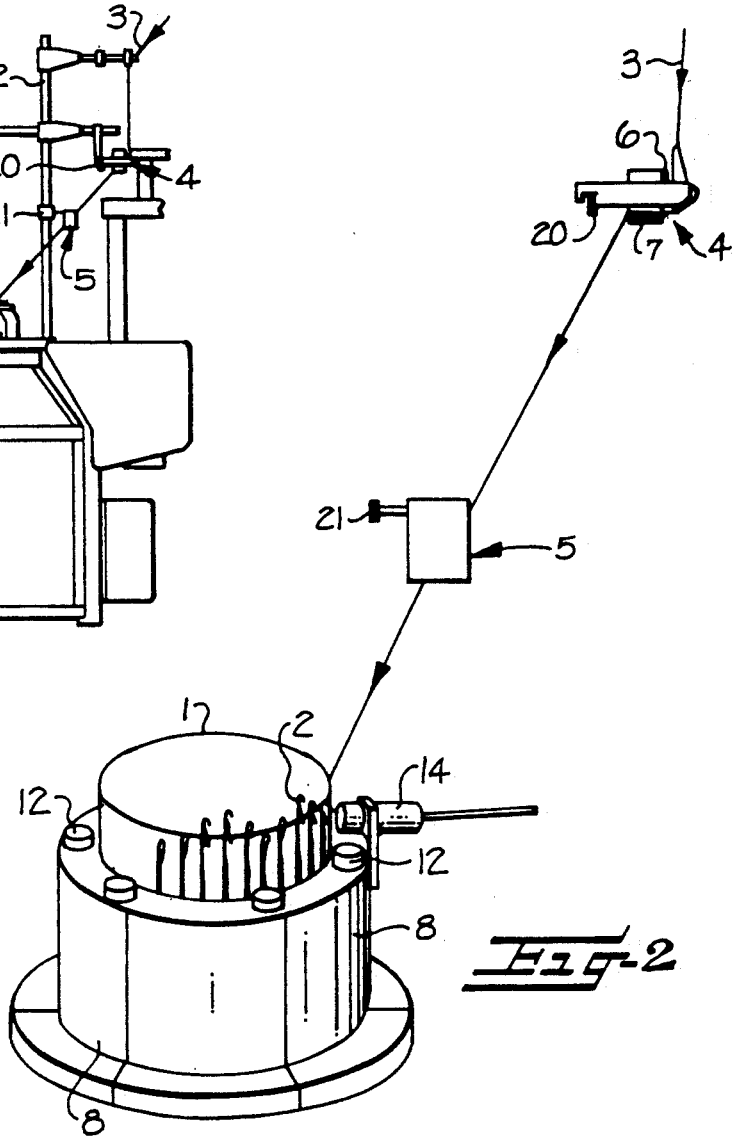
FIG. 2 is a fragmentary, elevation view showing the needle cylinder in isometric and a schematic of the yarn feeding mechanism.
Figure 3:
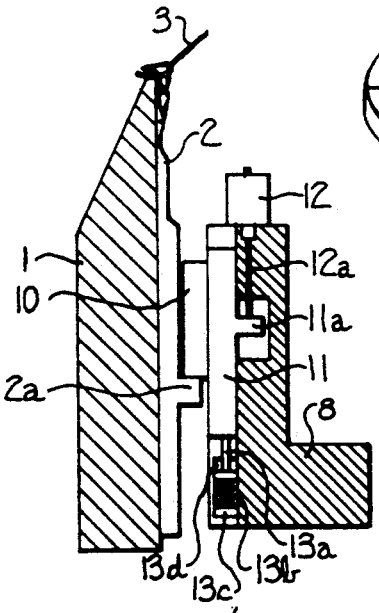
FIG. 3 is a vertical section view through the needle cylinder and adjacent stitch cam, showing the positional relationship among the control motor, stitch cam support member, and sensor.
Figure 4:
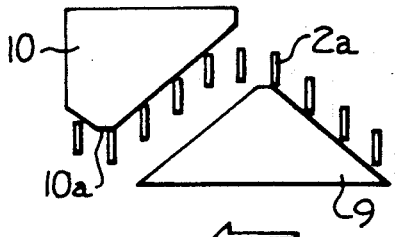
FIG. 4 is a fragmentary view schematically showing the manner in which needle butts successively engage raising and stitch cams.

As shown in FIG. 2, a rotating needle cylinder 1 is supported on a driven ring gear (not shown). The needle cylinder 1 is provided with the usual vertically extending needle slots in which needles, indicated at 2, are supported for vertical movement parallel to the axis of rotation of the needle cylinder 1. Each knitting needle 2 is provided with at least one operating butt 2*a* (FIG. 3), for successively engaging a needle raising cam 9, and a stitch cam 10 positioned at each knitting station around the needle cylinder (FIG. 4).

Cam support brackets 8 are supported on the inner surface of a conventional cam holder ring (not shown) and extend around the periphery of the needle cylinder 1, as illustrated in FIG. 2. Stitch cam support members 11 are slidably mounted on the cam support brackets 8 for slidable, vertical movement along the cam support brackets 8 (FIG. 3). Stitch cams 10 are fixed on the moveable stitch cam support members 11 and engage the acting butts 2*a* of the needles 2 for lowering the needles to a loop formation point 10*a* (FIG. 4) as the yarn is fed at yarn feeding positions, located around the periphery of the needle cylinder (FIG. 2). Needle raising cams 9 are fixed to the cam support brackets 8 opposite the cylinder 1 and engage the butts 2*a* of the needles for raising the knitting needles (FIG. 4).

Figure 1:
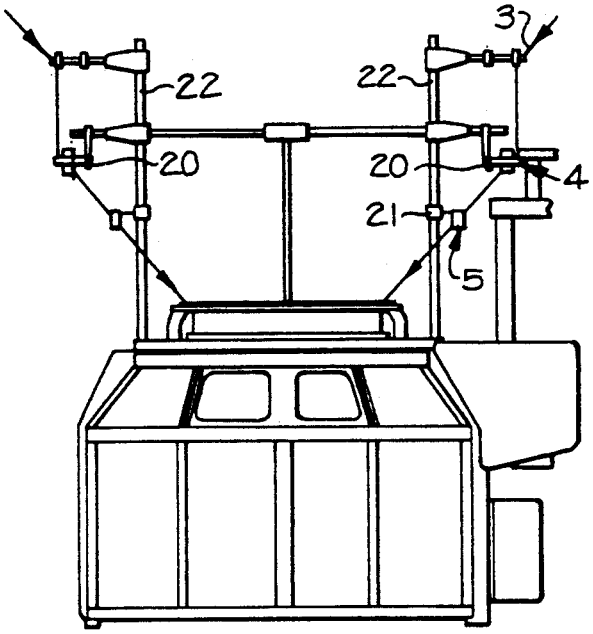
FIG. 1 is a front elevation view of the knitting machine in accordance with the present invention.

A yarn creel assembly is illustrated partially in FIG. 1 and includes thereon a positive type yarn feeding mechanism, broadly indicated at 4, for feeding the yarn, indicated at 3, into each knitting station of the knitting machine. The yarn feeding mechanism 4 is fixed on a support ring 20 supported in spaced positions by creel support masts 22. A conventional drive belt 6 (FIG. 2) operates each of the positive feed mechanisms 4. Two drive methods can be used with the positive feeding mechanism 4. The yarn 3 can be nipped between the drive belt 6 and a wheel, or the yarn is wound around the periphery of a drum 7, as disclosed in the illustrated embodiment (FIG. 2). Alternatively, a nonpositive feed mechanism can be used instead of the illustrated positive feed mechanism.

A small control motor 12 is mounted on the upper surface of each cam support bracket 8 (FIG. 3). The motor shaft 12*a* extends down and engages the top portion of a laterally extending projection 11*a* of the movable support member 11. A control motor 12, such as an SPS 20 series manufactured by Copal Electronics Company, Ltd. in Tokyo, Japan, has been found acceptable for use with the present invention. The output shaft 12*a* can be threaded or nonthreaded. When a threaded output shaft is used, the projecting portion 11*a* of the movable support member 11 includes an opening having internal screw threads for receiving the threaded portion of the output shaft 12*a*.

A gap closing and pressure sensing mechanism 13*c* is positioned in the space below the lower portion of each movable support member 11 and engages the respective cam support bracket 8. A cylindrical receiving plunger member 13*a* is positioned below the lower portion of the movable support member 11. The plunger 13*a* and a coil spring 13*b* are contained in the housing 13*d*. The coil spring 13*b* biases upward the movable support member 11 to remove any gap formed between the motor shaft 12*a* and the projection 11*a* of the movable support member 11.

The pressure sensor 13*c* is positioned at the lower portion of the coiled spring 13*b* and is fixed to the cam support bracket 8. The pressure sensor 13*c* detects the downward force exerted by the movable support member 11 onto the coil spring 13*b*. The pressure sensor 13*c* generates a signal to a main controller, broadly indicated at 101, (FIG. 7), indicative of the amount of downward force exerted by the movable support member 11. Different pressure sensors 13*c* may be used such as conventional optical sensing devices, differential transformers, linear scales and ultrasonic wave detection mechanisms. As an alternative to the coil spring 13*b*, an air cylinder or a oil dampener may be used for exerting an upward biasing force against the movable support member 11. In those embodiments, the amount of force exerted against the air cylinder or oil damper may be sensed and measured by appropriate sensors.

Along the upper portion of the needle cylinder 1, a knitting machine monitor sensor 14 is positioned for detecting the rotational speed of the needle cylinder 1. Additionally, the sensor 14 may detect the rotational movement of individual needles, i.e., the position of the stitch cam members 10 while transmitting data on the detected results to the main controller 101.

Figure 5:
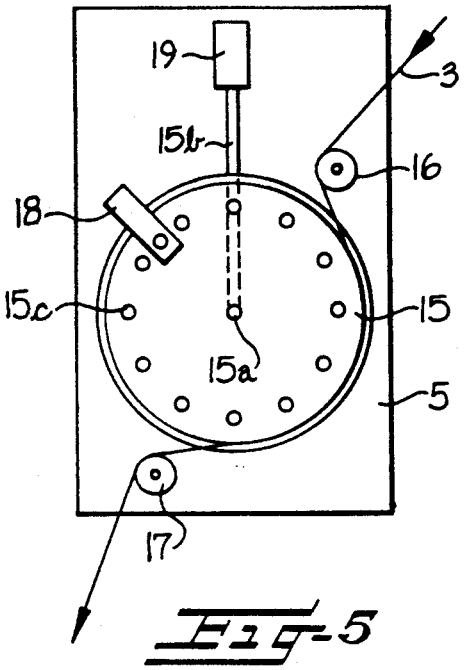
FIG. 5 is a elevational view of the yarn feed tension and quantity measuring mechanism.
Figure 6:
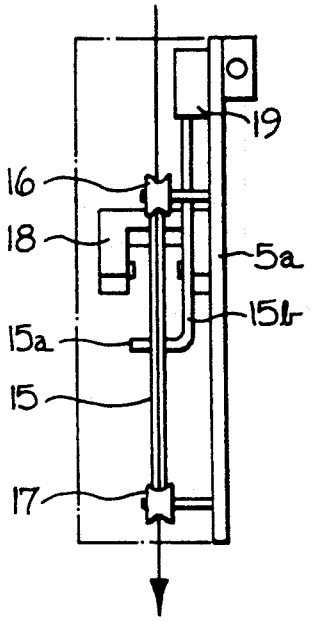
FIG. 6 is a side view of the yarn feed tension and quantity measuring mechanism.

Referring now to FIGS. 5 and 6, there is illustrated in greater detail the yarn speed and tension measuring mechanism 5. The mechanism 5 includes a support plate 5*a*. Entry and exit guide rollers 16 and 17 are supported on the plate 5*a* for guiding the yarn 3 into engagement with the periphery of a yarn guide drum 15 positioned at a yarn condition measuring position. The drum 15 is preferably supported on the plate 5*a* in a manner so that tension exerted by the yarn 3 against the drum 15 displaces the drum 15 a distance proportional to the amount of tension exerted by the yarn 3 against the drum 15. A connecting rod 15*b* extends from the axis of the drum 15 and connects to a yarn tension sensor 19 which measures the displacement corresponding to the proportional amount of tension exerted by the yarn 3 against the drum 15.

As illustrated, the yarn 3 passes over the entry guide roller 16 and engages the lower portion of the drum 15 through an angle of approximately 180°. The yarn 3 then extends from the lower portion of the drum periphery and over the exit guide roller 17 positioned on the outgoing side of the drum 15. The yarn 3 then travels to the needle cylinder 1 and into the knitting needles 2. When the yarn tension is high, the drum 15 is displaced to the upper left side, as illustrated in FIG. 5, and the connecting rod 15*b* bends slightly. The yarn sensor 19 detects yarn tension as an amount proportional to the amount of bending in the connecting rod 15*b*.

The drum 15 also includes a plurality of holes 15*c* evenly spaced along the peripheral edge of the drum 15. An optical sensor 18 is mounted on the plate 5*a* and detects the speed of rotation of the holes 15*c* as the drum 15 rotates and yarn 3 is guided along the periphery of the drum. Information on sensed displacement is input to the main controller 101 which calculates the quantity of yarn fed to the needles.

Figure 7:
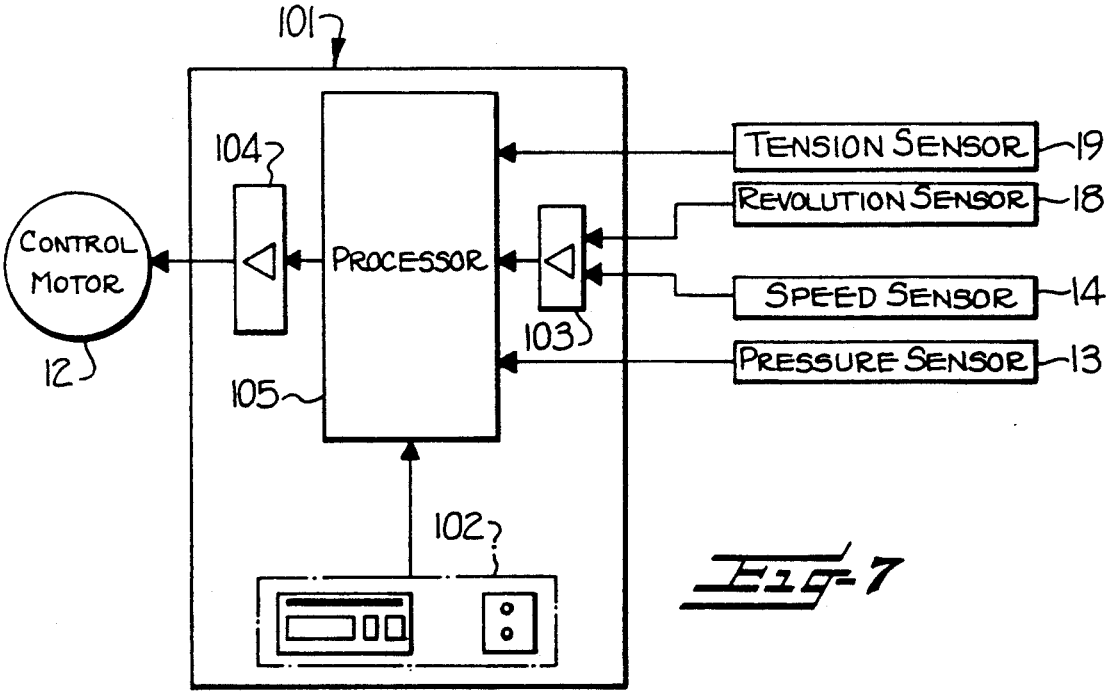
FIG. 7 is a block diagram depicting the input of various sensors to the controller.

Referring now to FIG. 7, there is illustrated a block diagram of the main controller 101. The main controller 101 includes an input mechanism 102 for inputting data about knitting conditions, such as the type of knitting machine and the desired stitch, into the memory of the main controller 101. The input mechanism 102 includes the conventional elements such as a key board, floppy disk, and ROM and RAM boards. This data is input to a central processing unit 105 composed of conventional boards and memory components.

Data received from the sensors 18 and monitoring mechanism 14 are transmitted to the central processing unit through a conventional comparator 103. The central processing unit 105 compares the signals received from the comparator 103 with the initial predetermined knitting machine operating standards. When a difference larger than a fixed amount is detected, a corrective signal is transmitted to the motors 12 through a signal amplifier 104 for moving the stitch cams 10 and correcting the knitting machine operation. The signals generated by the yarn tension sensor 19 and the pressure sensor 13 also are input directly to the central processing unit 105 and compared with the initial knitting machine operating standards. When a difference from the operating standard greater than desired is detected, a corrected yarn tension signal is transmitted to the motor 12 through the amplifier 104 for correcting the height of the stitch cams 10. Depending on the type of yarn feeding mechanism, i.e., a positive or nonpositive type, the central processing unit 105 controls the tension and quantity of yarn fed depending on the type of feeding mechanism, the type of knitting machine and the desired stitch.

Figure 8:
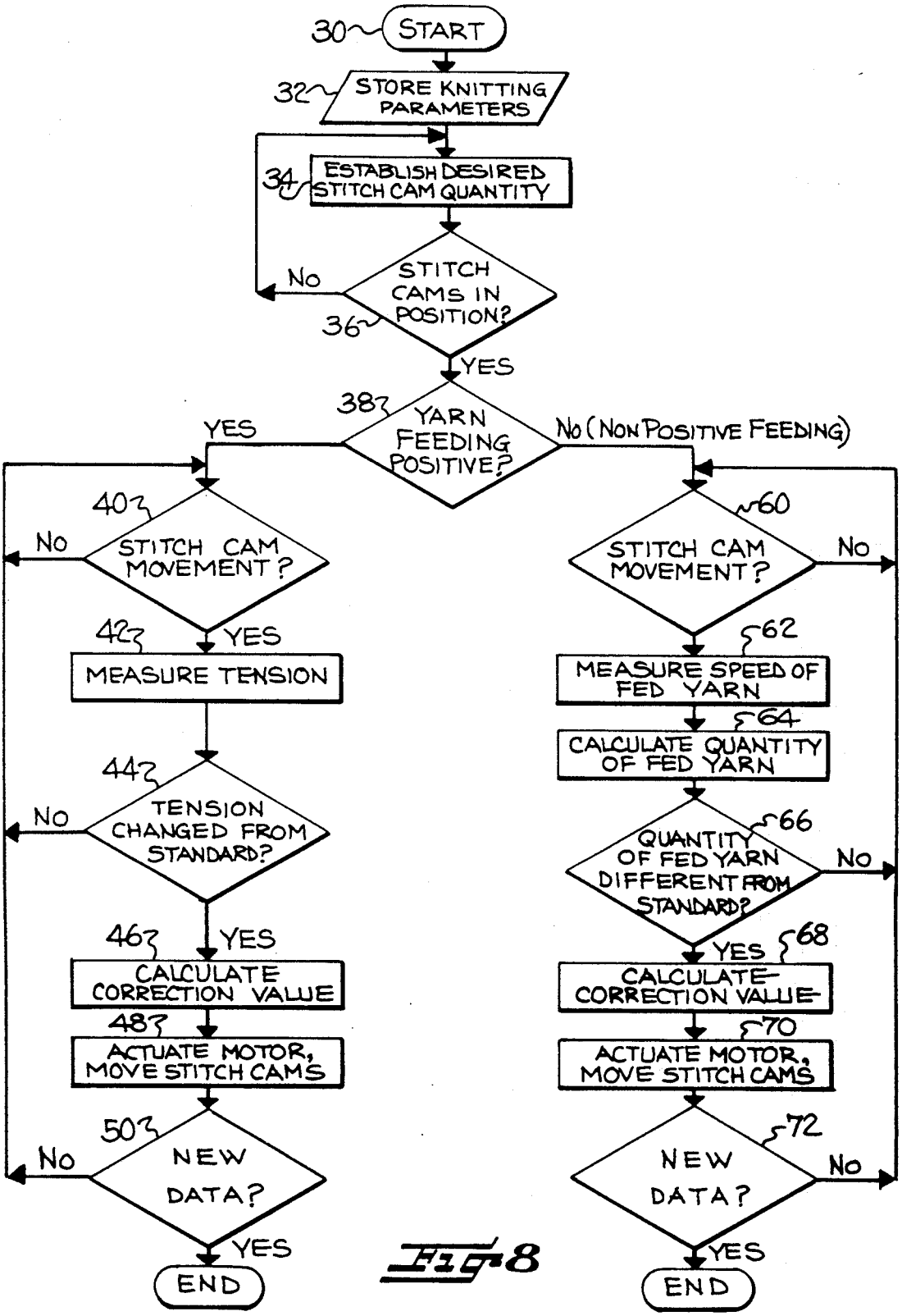
FIG. 8 is a flow chart illustrating the method of operation of the knitting machine in accordance with the present invention.

Referring now to FIG. 8, there is illustrated a flow chart depicting the sequence of steps followed in the practice of the invention when either a positive or nonpositive yarn feeding mechanism is used. At the start (Block 30), data containing knitting machine operating parameters relating to the type of yarn feeding mechanism, i.e., positive or non-positive, yarn length per stitch, yarn tension and other parameters are fed to the central processing unit 105 by means of the input mechanism 102 (Block 32). Data relating to the position of the stitch cams at each yarn feeder is established prior to knitting based on the knitting machine operating parameters. This data is fed to the central processing unit 105 through the input mechanism 102 (Block 34).

The position of each stitch Cam 10 is confirmed (Block 36) based on information received from the pressure sensors 13*c* corresponding to the position of the movable support members 11 along the vertical path of movement. If the generated information is deemed incomplete, the step corresponding to Block 34 is repeated again until a desired stitch cam position is obtained. Once the desired stitch cam position is obtained, a predetermined method of operation is followed depending on the type of feeding mechanism, i.e., a positive or a non-positive feeding mechanism.

If a positive yarn feeding mechanism such as illustrated in FIG. 1 is used, the sequence of steps shown in the flow chart pattern on the left-hand side of FIG. 8, Blocks 40 through 52, are followed. During knitting, the monitoring mechanism sensor 14 monitors the position of the stitch cams 10 (Block 40). If there has been no stitch cam movement, that step (Block 40) is repeated until the stitch cams have moved. Stitch cam movement occurs through mechanical tolerance error in the knitting machinery, or the generated heat and stresses produced during the knitting operation.

When the monitoring mechanism 14 establishes that the stitch cams 10 have moved, tension then is measured through the yarn tension sensor 19 (Block 42). That measured result is fed directly to the central processing unit 105. If there has been no change in tension, the steps beginning with Block 40 are repeated again. If there has been a change in tension from the standard operating knitting machine standard previously established the central processing unit 105 calculates a corrected stitch cam position value (Block 46). The motor 12 is actuated to move the individual stitch cams 10 to the desired setting (Block 48). If there is not any new data for the knitting operation, the sequence of steps begins again (Block 50). If there is new data, the sequence of steps ends (Block 52) and the sequence of steps begins again at Block 30.

When a non-positive feeding mechanism is used, the sequence of steps exhibited in the right-hand side of the flow chart is followed. If the stitch cams 10 remain stationary during knitting, the sequence of steps are repeated similar to the loop of Block 40. If there is a measured stitch cam movement, the speed of the fed yarn is measured by the sensor 18 (Block 62). This yarn speed is input to the central processing unit and the quantity of fed yarn is calculated (Block 64). If the quantity of fed yarn is within the knitting machine operating standard established this step is repeated. If the quantity of fed yarn differs from the knitting machine operating standard, the central processing unit 105 calculates a corrected value corresponding to the amount of yarn which should be fed to the needles (Block 68). The motor 12 is actuated and the stitch cams are moved to obtain the corrected value (Block 70). If there is not any new data (Block 72), the step is repeated. If there is new data, the sequence of steps are ended (Block 74) and the program begins again at Block 30.

The range of tolerance within the knitting machine operating standard depends on the type of knit fabric, the desired quality, the type of knitting machine and other operating standards established by the individual knitting mill. This automatic stitch adjustment mechanism in accordance with the present invention is advantageous over other prior art mechanisms where changes in stitch cam position arising through temperature and speed variations cannot be corrected. The present invention provides for automatic adjustment of the stitch cams as needed.

In the drawings and specification there has been set forth the best mode presently contemplated for the practice of the present invention. Although specific terms are employed, they are used in a generic and descriptive sense only, and not for purposes of limitation, the scope of the invention being defined in the claims.

What is claimed is:

1. In a circular knitting machine including a plurality of yarn receiving knitting needles supported in a rotating needle cylinder for vertical movement parallel to an axis of rotation of said needle cylinder, a plurality of cam support brackets surrounding said needle cylinder, a plurality of stitch cam support members mounted on and vertically movable relative to said cam support brackets, and stitch cams mounted on said vertically movable stitch cam support members for engaging said needles and at desired times lowering said needles to desired yarn loop formation points, the combination therewith of an automatic stitch adjusting mechanism for automatically changing the elevation of said stitch cams, said stitch cam adjusting mechanism comprising drive means connected to said stitch cam support members for vertically moving said stitch cam support members and for thereby vertically moving said knitting needles to desired vertical positions, first sensing means for sensing the vertical positions of said movable stitch cam support members and for generating signal data representative thereof, second sensing means for sensing the rotational speed of said needle cylinder and generating signal data representative thereof, and third sensing means for measuring a feeding characteristic of the yarn knitted by said machine and for generating signal data indicative thereof, and control means for receiving said signal data from said first sensing means and from said second sensing means and for comparing said signal data with standard data and for causing said stitch cam adjusting mechanism to adjust the vertical position of at least one of said stitch cams when said signal data and said standard data differ by a preselected extent.

2. In a circular knitting machine as in claim 1, wherein said feeding characteristic of said yarn is yarn feed tension, and wherein said control means causes said stitch cam adjusting mechanism to reduce the tension of said yarn when said tension differs by a preselected amount from said standard value.

3. A circular knitting machine according to claim 1 wherein said means for measuring a yarn feeding characteristic measures the yarn tension.

4. A circular knitting machine according to claim 1 wherein said means for measuring a yarn feeding characteristic measures the speed of the yarn being fed to the machine.

5. A circular knitting machine according to claim 1 including biasing means supported by said cam support brackets and engaging said stitch cam support members for biasing upward said stitch cam support members.

6. A circular knitting machine according to claim 5 wherein said sensing means is operatively connected to said biasing means for sensing the amount of biased force exerted on each of said stitch cam support members.

7. A circular knitting machine according to claim 5 wherein said biasing means comprises a spring.

8. A circular knitting machine according to claim 1 wherein said drive means connected to said stitch cam support members comprises a plurality of motors individually connected to a respective stitch cam support member.

9. In a circular knitting machine including a plurality of knitting needles supported in a rotating needle cylinder for vertical movement parallel to an axis of rotation of the needle cylinder and having a positive feed for feeding yarn to the knitting needles, a plurality of stitch cam support members slidably mounted no said cam support brackets for vertical movement thereon, and stitch cams mounted on said vertically movable stitch cam support members for engaging the needles and lowering the needles to a loop formation point, the combination therewith of an automatic stitch adjusting mechanism for changing automatically, the stitch cam elevation, said adjusting mechanism comprising drive means connected to said stitch cam support members for vertically moving said stitch cam support members, sensing means for (a) sensing and generating signal data representative of the vertical position of each movable stitch cam support member along a vertical path of movement, (b) for detecting and generating signal data representative of the rotational speed of the needle cylinder, and for measuring and generating signal data representative of the tension of the yarn fed into the knitting machine; and control means operatively connected to said drive means and said sensing means for comparing each of the sensed data to a predetermined knitting machine operating standard, said control means actuating said drive means for vertical adjustment of said stitch cam support members.

10. A circular knitting machine according to claim 9 wherein said control means includes means for generating a drive signal for actuating said drive means and moving said stitch cam support members when a sensed value varies from the predetermined knitting machine operating standard.

11. In a circular knitting machine including a plurality of knitting needles supported in a rotating needle cylinder for vertical movement parallel to an axis of rotation of the needle cylinder and having a nonpositive feed for feeding yarn to the knitting needles, a plurality of cam support brackets surrounding the needle cylinder, a plurality of stitch cam support members slidably mounted on said cam plates for vertical movement thereon, and stitch cams mounted on said vertically movable stitch cam support members for engaging the needles and lowering the needles to a loop formation point, the combination therewith of an automatic stitch adjusting mechanism for changing automatically the stitch cam level, said adjusting mechanism comprising drive means connected to each of said stitch cam support members for moving said stitch cam support members vertically, sensing means for sensing vertical positions of said movable support members detecting means for detecting the rotation speed of the needle cylinder, measuring means for measuring the quantity of yarn fed to the needles, and control means operatively connected to said drive means, sensing means, rotational speed detection means, and said yarn quantity measuring means for comparing each of the sensed values to a predetermined knitting machine operating standard, said control means actuating said drive means for vertical adjustment of said stitch cam support member.

12. A circular knitting machine according to claim 11 wherein said control means includes means for generating a drive signal for actuating said drive means and moving said stitch cam support members when a sensed value varies from the predetermined knitting machine operating standard.

13. A method for automatically adjusting the stitch of a knitting machine having a plurality of knitting needles supported in a rotating needle cylinder for vertical movement parallel to the axis of rotation of the needle cylinder, a plurality of cam support brackets surrounding the needle cylinder, a plurality of stitch cam support members slidably mounted on said cam support brackets for vertical movement thereon, stitch cams mounted on said vertically movable stitch cam support members for engaging the needles and lowering the needles to a loop formation point, drive means connected to each of said stitch cam support members for moving said stitch cam support members up and down, the method comprising the steps of a) comparing a yarn feeding parameter with a predetermined knitting machine operating standard, and
b) changing the position of the stitch cam members when the compared value of the yarn feeding parameter differs from the predetermined standard by causing the drive means to move the stitch cam support members vertically.

14. The method according to claim 13 wherein said step of measuring a yarn feeding parameter comprises the step of measuring the tension of yarn fed into the knitting machine.

15. The method according to claim 13 wherein said step of measuring a yarn feeding parameter comprises the step of measuring the quantity of yarn fed into the knitting machine.

16. The method according to claim 13 including the step of biasing the stitch cam members upwardly and sensing the amount of the biasing force against the stitch cam members for indicating the position of the stitch cams.

17. In a circular knitting machine including a plurality of knitting needles supported in a rotating needle cylinder for vertical movement parallel to an axis of rotation of the needle cylinder and having a positive feed for feeding yarn to the knitting needles, a plurality of a cam support brackets surrounding the needle cylinder, a plurality of stitch cam support members slidably mounted on said cam support brackets for vertical movement thereon, and stitch cams mounted on said vertically movable stitch cam support members for engaging the needles and lowering the needles to a loop formation point, the combination therewith of an automatic stitch adjusting mechanism for changing automatically the stitch cam elevation, comprising drive means connected to said stitch cam support members for moving said stitch cam support members vertically, sensing means for sensing and generating signal data representative of the vertical position of each of said movable stitch cam support members, sensing means for detecting and generating signal data representative of the rotational speed of said needle cylinder, sensing means for measuring and generating signal data representative of the quantity of the yarn fed into the knitting machine, and control means for receiving said signal data and comparing said data to a predetermined knitting machine operating standard, said control means actuating said drive means for vertical adjustment of said stitch cam support member.

* * * * *